US007125311B2

(12) United States Patent
Wang

(10) Patent No.: US 7,125,311 B2
(45) Date of Patent: Oct. 24, 2006

(54) DEVICE FOR POSITIONING A TELESCOPIC DOLL IN A PACKING BOX

(75) Inventor: Sheng-Chien Wang, Taichung Hsien (TW)

(73) Assignee: Gemmy Industries Corporation, Coppell, TX (US)

( * ) Notice: Subject to any disclaimer, the term of this patent is extended or adjusted under 35 U.S.C. 154(b) by 0 days.

(21) Appl. No.: 11/043,999

(22) Filed: Jan. 28, 2005

(65) Prior Publication Data

US 2006/0172658 A1 Aug. 3, 2006

(51) Int. Cl.
*A63H 3/00* (2006.01)
*A63H 3/36* (2006.01)
*A63H 33/30* (2006.01)
*A63J 19/00* (2006.01)

(52) U.S. Cl. ..... 446/268; 446/331; 446/390; 446/478

(58) Field of Classification Search ..... 446/390, 446/353, 330, 331, 354, 355, 356, 478, 487, 446/268, 320, 71, 73, 361, 380; 206/477–483; 40/411, 414, 415, 418, 420
See application file for complete search history.

(56) References Cited

U.S. PATENT DOCUMENTS 3,406,816 A * 10/1968 Green et al. ..... 446/73
3,675,362 A * 7/1972 Gelder et al. ..... 446/83
4,040,206 A * 8/1977 Kimura ..... 446/352
4,591,345 A * 5/1986 Kohner ..... 446/361
5,707,269 A * 1/1998 Murphy ..... 446/268
5,718,335 A * 2/1998 Boudreaux ..... 206/461
5,941,756 A * 8/1999 Chou ..... 446/330
5,980,352 A * 11/1999 Rigberg ..... 446/73
6,572,433 B1 * 6/2003 Hou ..... 446/353
6,652,351 B1 * 11/2003 Rehkemper et al. ..... 446/354

* cited by examiner

*Primary Examiner*—Faye Francis
(74) *Attorney, Agent, or Firm*—Rabin & Berdo, P.C.

(57) ABSTRACT

A device for positioning a telescopic doll in a packing box includes a telescopic doll and a packing box. The telescopic doll has two feet each with a sole, a seat formed on the sole, and a first hook pivotally mounted on the seat. Two fixed legs respectively extend upwards from the feet. Two first rod are telescopically and respectively mounted on the fixed legs. Each first rod has a line extending from a bottom end of the first rod through the shaft and connected to the first hook. Two second rods are telescopically and respectively mounted on the first rods. The packing box has a bottom plate and a second hook formed on the bottom plate and detachably engaged with the first hook. Whereby, the doll can be easily unfolded and taken out from the packing box.

7 Claims, 7 Drawing Sheets

DEVICE FOR POSITIONING A TELESCOPIC DOLL IN A PACKING BOX

BACKGROUND OF THE INVENTION

1. Field of the Invention

The present invention relates to a positioning device, and more particularly to a device for positioning a doll in a packing box by which the doll can be easily detached from the packing box.

2. Description of Related Art

A telescopic doll can be folded and packed in a box for being stored or transported. However, if the doll is packed in the box without any positioning means, it will be rocked in the box and may be damaged during transportation. Thus, the doll often is positioned in the box by screws or other fasteners for transportation. For unpacking the doll, the fasteners must be removed by a tool (such as a screwdriver) and thus it is very inconvenient to pack and unpack the telescopic doll.

Therefore, the invention provides a telescopic doll to mitigate or obviate the aforementioned problems.

SUMMARY OF THE INVENTION

The main objective of the present invention is to provide a device for positioning a telescopic doll in a packing box by which the telescopic doll can be conveniently and easily removed from the packing box.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
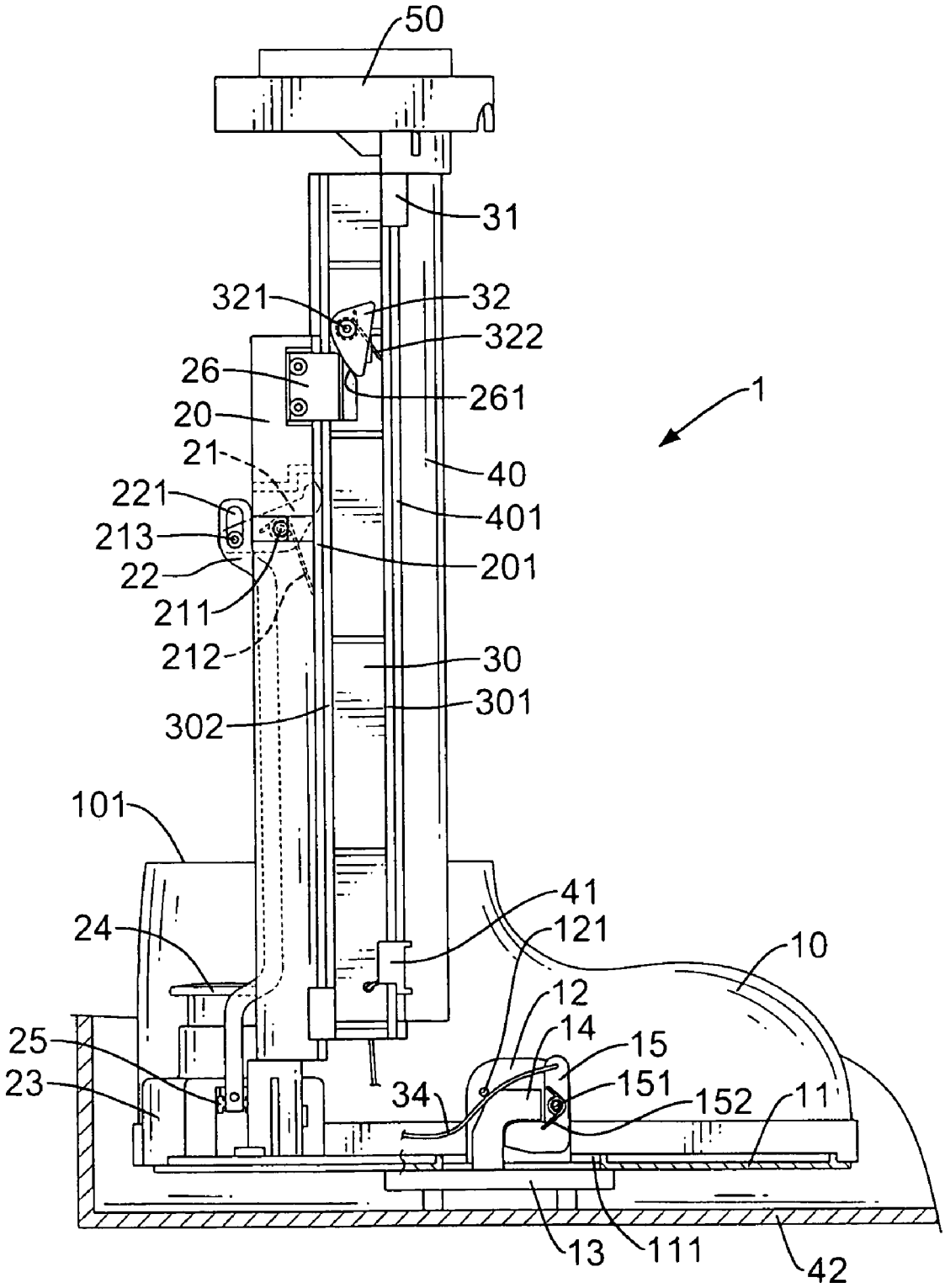
FIG. 1 is a side view of a telescopic doll positioned in a packing box.

With reference to FIGS. 1–4, according to the present invention, a telescopic doll (1) is detachably positioned in a packing box (42).

The telescopic doll (1) has two hollow feet (10). Each foot (10) has a sole (11), an ankle portion, and open end (101), a seat (12), an opening (111), a shaft (121), a first hook (15) and a first torsion spring (152). The open end (101) is defined at the ankle portion of the foot (10). The seat (12) with two ears is formed on the sole (11). The opening (111) is defined through the sole (11) and under the seat (12). The shaft (121) is provided between the ears of the seat (12). The first hook (15) is pivotally mounted on the seat (12) by a first pivot pin (151). The first torsion spring (152) is provided on the first pivot pin (151) and has a first end fixed on the hook (15) and a second end fixed on the seat (12).

The packing box (42) has a bottom plate (13) and two second hook hooks (14) formed on the bottom plate (13). The second hooks (14) respectively extend through the openings (111) and detachably engage with the first hooks (15).

Each of the feet (10) further has a fixed leg (20), a first rod (30) and a second rod (40). The first rod (30) extends upwards through the open end (101). The first rod (30) is mounted telescopically on the fixed leg (20). The second rod (40) is mounted telescopically on the first rod (30).

The fixed leg (20) has a front side, first wing (201), a first joint (21), a second torsion spring (212) and a first guide (26). The first wing (201) is formed at the front side. The first joint (21) and the second torsion spring (212) are pivotally mounted in the fixed leg (20) by a second pivot pin (211). The first joint (21) can partially extend from the front side of the fixed leg (20). The first guide (26) is provided at a top portion of the front side of the fixed leg (20), and has an inclined surface (261) and a first channel (262). The inclined surface (261) is formed at a frontupper corner of the first guide (26). The first channel (262) is longitudinally defined in the first guide (26).

Each first rod (30) has a front side, a rear side, a second wing (301), a third wing (302), a second joint (32), a third torsion spring (322), a second guide (31) and a line (34). The second wing (301) and third wing (302) are formed respectively at the front and rear sides. The third wing (302) is movably received in the first channel (262) of a corresponding one of the fixed legs (20). The second joint (32) and third torsion spring (322) are pivotally mounted in the first rod (30) by third pivot pin (321). The second guide (31) is provided at a top portion of the front side of the first rod (30) and has a second channel (311) longitudinally defined in the second guide (31). The line (34) extends from a bottom end of the first rod (30) through a corresponding one of the shafts (121) and is connected to a corresponding one of the first hooks (15). When the first rod (30) is moved about the fixed leg (20), the first joint (21) can extend out of or retract in the fixed leg (20).

The second rod (40) has a third wing (401) formed at a rear side thereof and movably received in the second channel (311) of corresponding one of the first rods (30).

The two feet (10) are connected together by a connecting portion (23) therebetween. A button (24) is provided on the connecting portion (23), and a resilient member (241) is received in the connecting portion (23) and provided on the button (24). A lever (25) is transversally provided in the connecting portion (23) and has a first end provided on the button (24). A linkage (22) is provided in the fixed leg (20) and has a first end pivotally mounted on the first joint (21) and a second end connected to a second end of the lever (25). The linkage (22) has an elongated hole (221) defined at the first end thereof. The first joint (21) is pivotally mounted on the first end of the linkage (22) by a fourth pivot pin (213) through the elongated hole (221). Thus, when the button (24) is pressed, the lever (25) can be moved downwards to pull the linkage (22).

Each first rod (30) further has two first limiting members (33) formed at two sides of the third wing (302) of the first rod (30) and movably attached to the first wing (201) of a corresponding one of the fixed legs (20), so the first rod (30) can be smoothly and stably moved along the fixed leg (20).

Each second rod (40) further has two second limiting members (41) formed at two sides of the fourth wing (401) of the second rod (40) and movably attached to the third wing (301) of a corresponding one of the first rods, so the second rod (40) can be smoothly and stably moved along the first rod (30).

An upper plate (50) is provided on the second rods (40).

Figure 2:
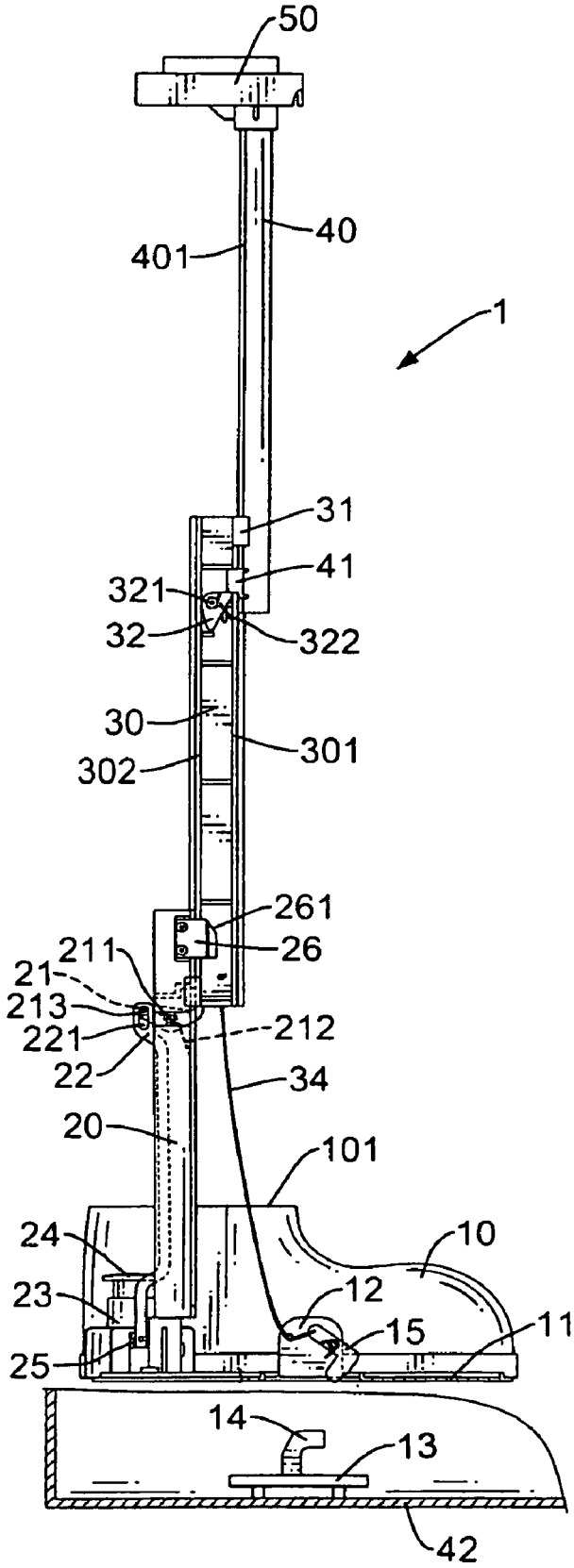
FIG. 2 is a side view of the telescopic doll being spread and removed from the packing box.
Figure 3:
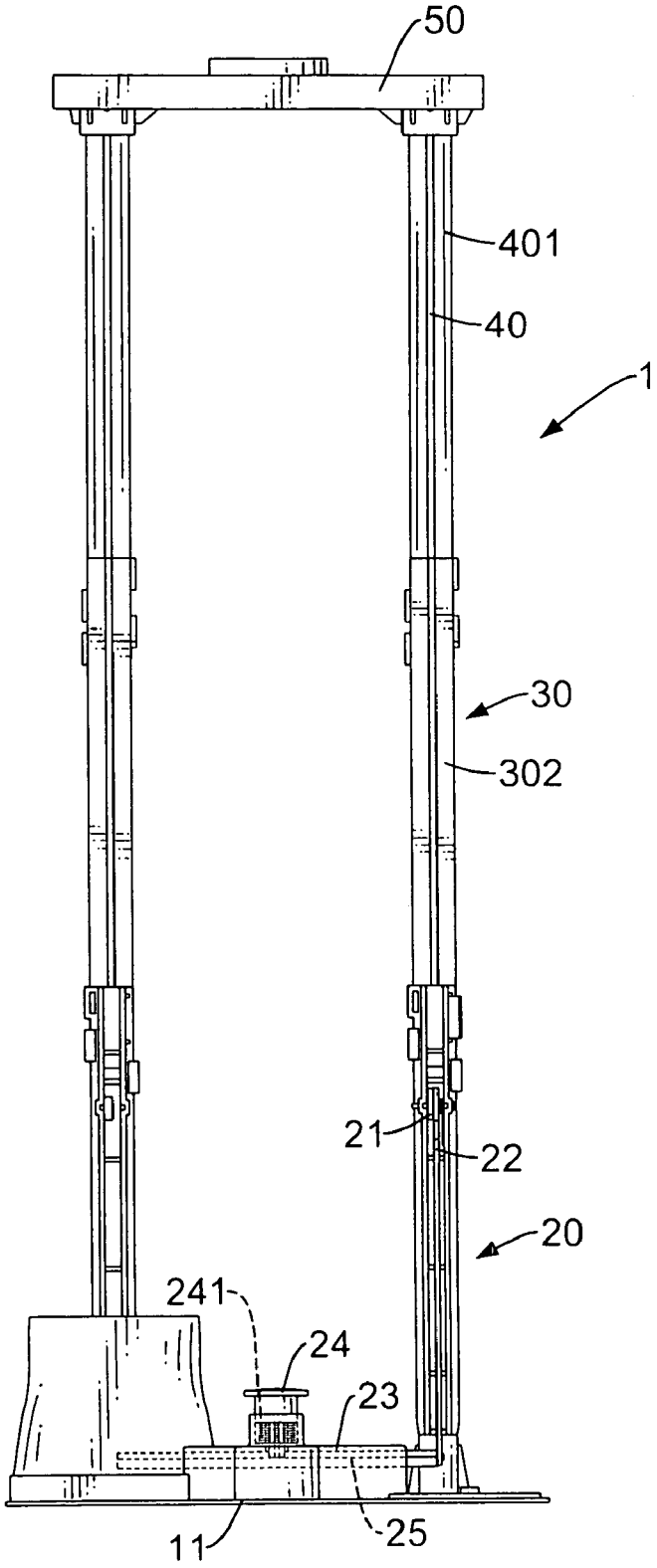
FIG. 3 is a rear view of the telescopic doll.
Figure 4:
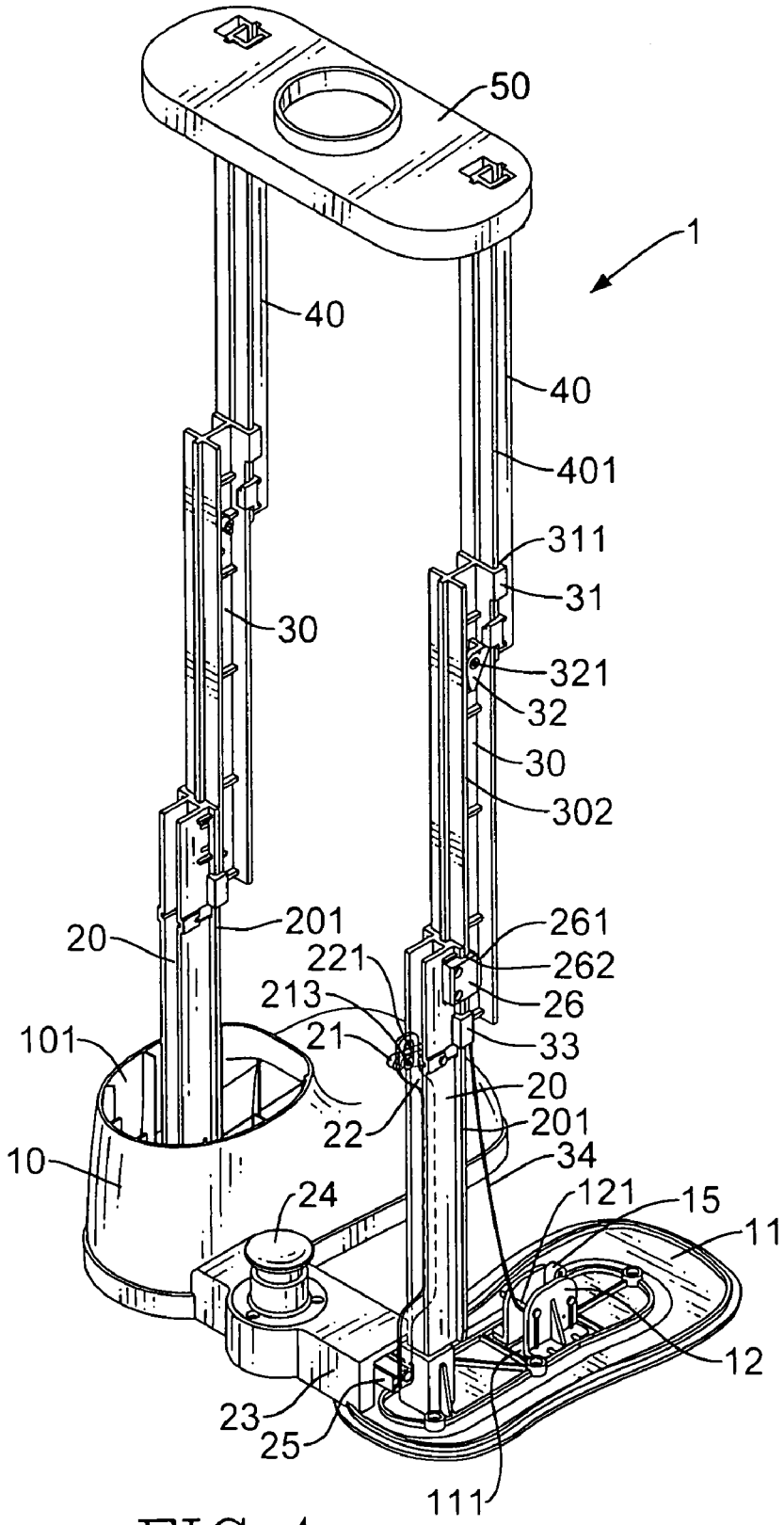
FIG. 4 is a perspective view of the telescopic doll.
Figure 5:
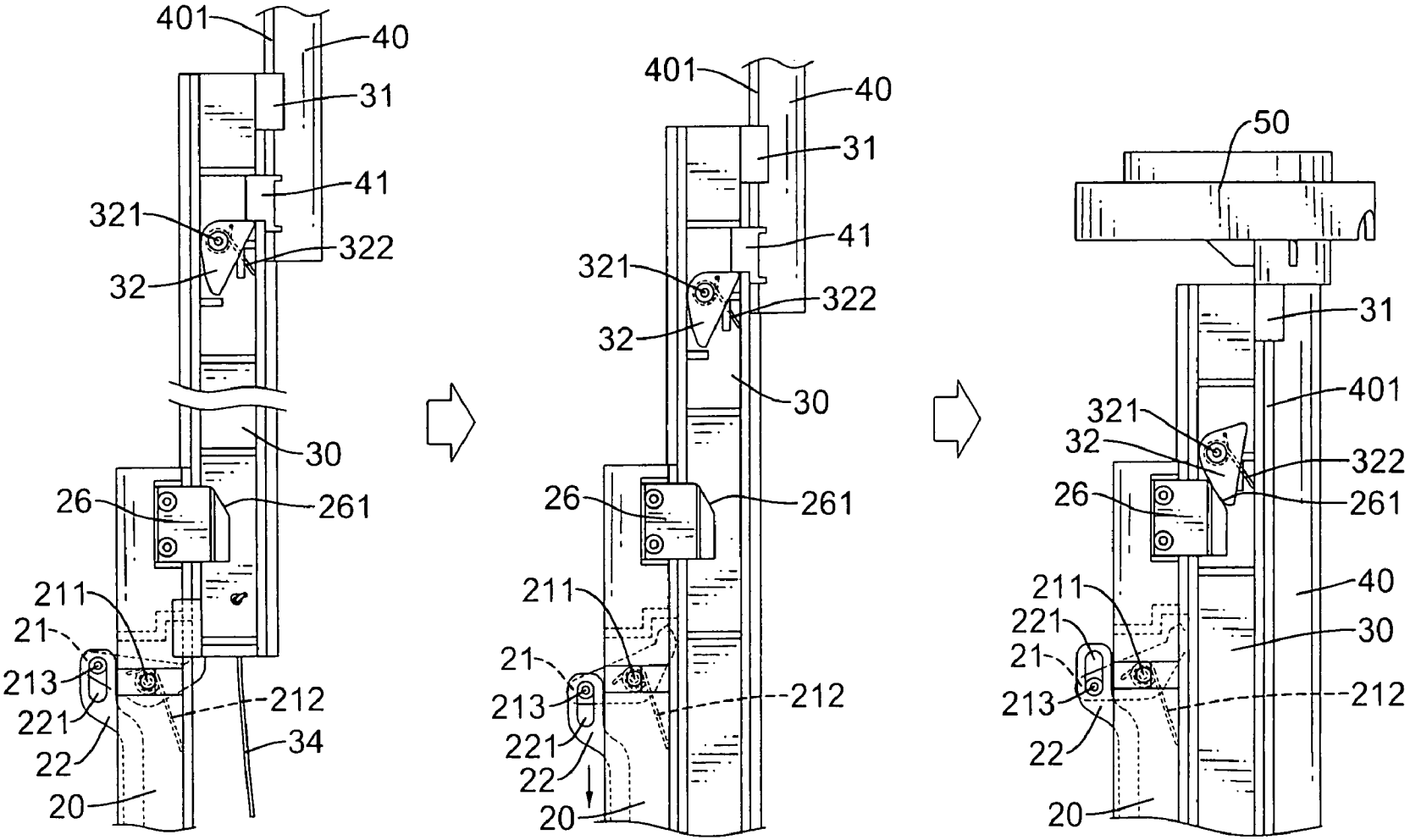
FIG. 5 is a schematic view of a folding procedure of the telescopic doll.
Figure 6:
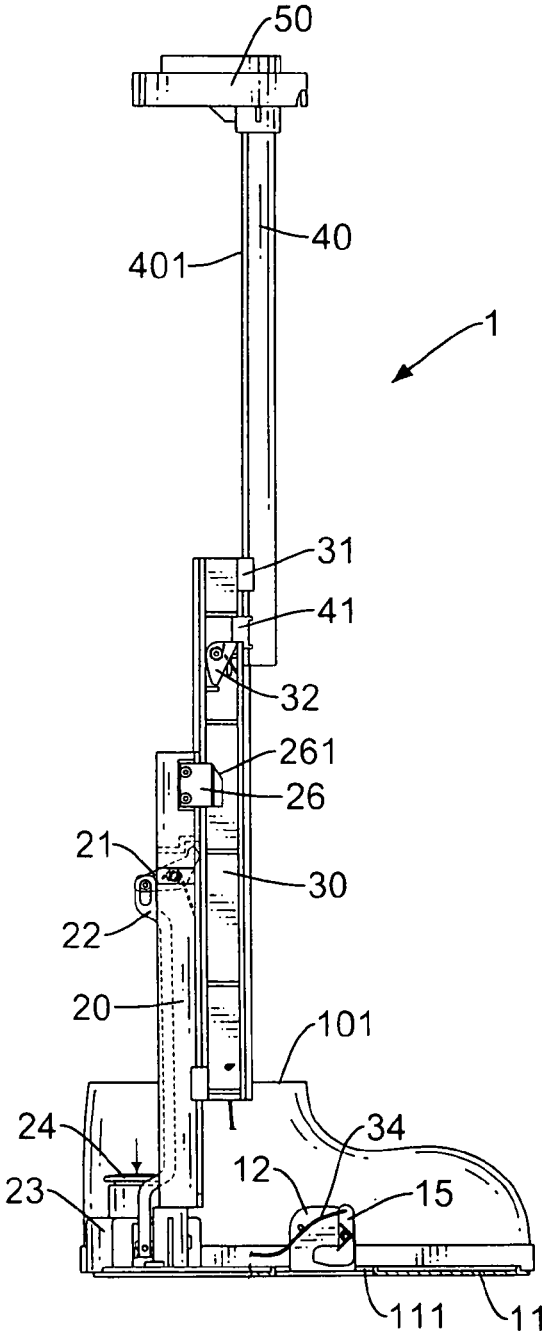
FIG. 6 is a schematic view showing a first rod and a second rod of the telescopic doll being pushed downwards.
Figure 7:
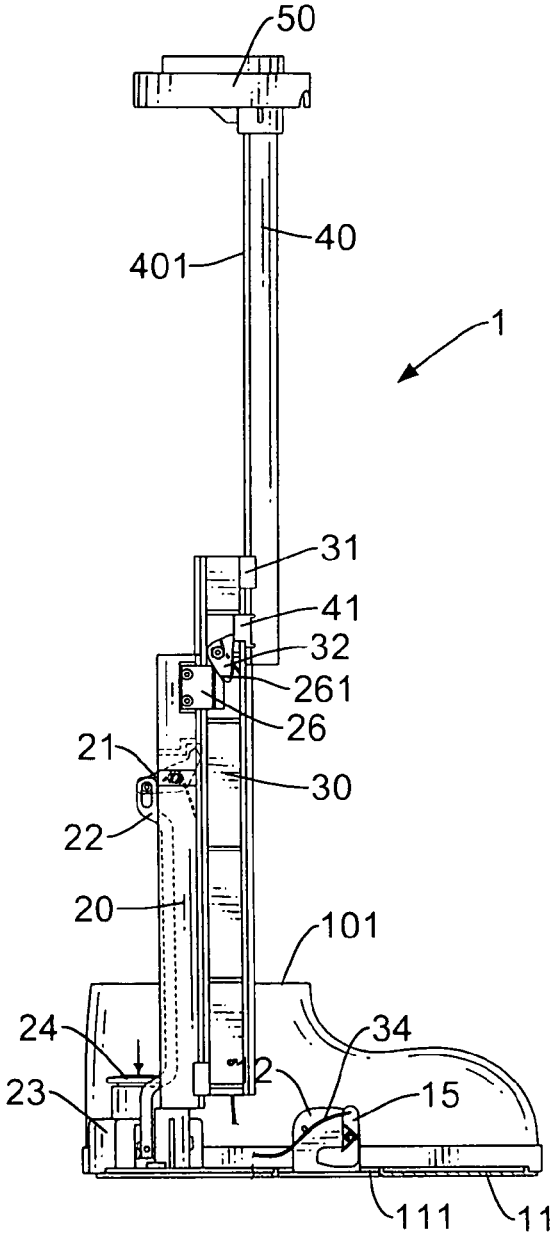
FIG. 7 is a schematic view showing the second rod of the second rod being pushed about the first rod.
Figure 8:
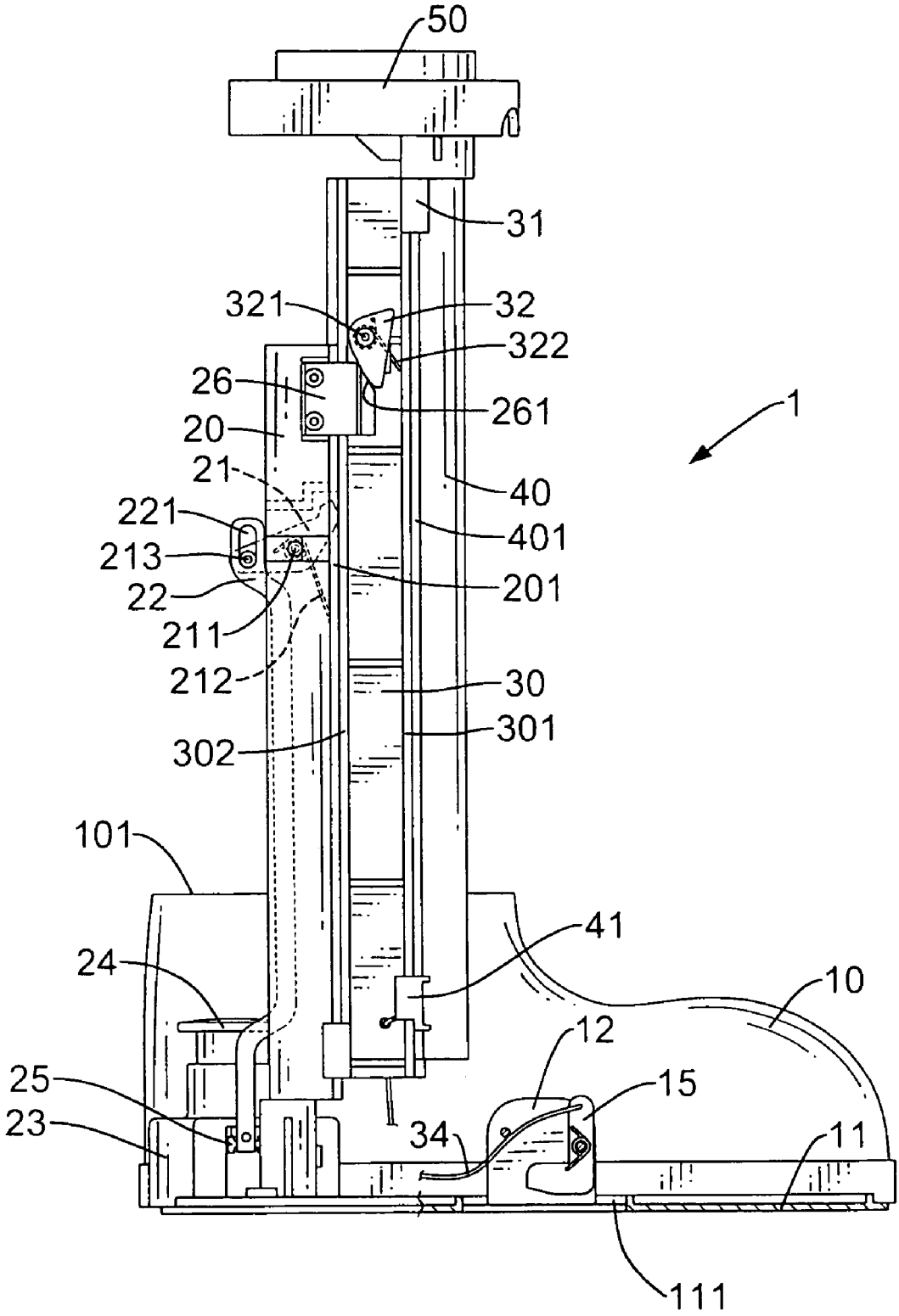
FIG. 8 is a schematic view of the telescopic doll being folded completely.

With reference to FIGS. 1 and 2, when the upper plate (50) is pulled upwards, the second, rod (40) is moved upwards. Pushed by the second limiting members (41), the second joint (32) is pivoted inwards to allow the second rod (40) to move upwards further. When the limiting members (41) are moved above the second joint (32), the second joint (32) can be pivoted back to the original position under the force of the third torsion spring (322), and the second rod (40) can be moved until the second limiting members (41) are obstructed by the second guide (31) of the first rod (30). Thereafter, the first rod (30) can be moved upwards along with the second rod (40). Pushed by the first limiting members (33), the first joint (21) can be pivoted inwards to allow the first rod (30) to move upwards further. When the limiting members (33) are moved above the first joint (21), the first joint (21) can be pivoted back to the original position under the force of the second torsion spring (212), and the first rod (30) can be positioned on the first joint (21).

During the upward movement of the first rod (30), the line (34) is tensioned to pull the first hook (15). Thus, the first hook (15) is pivoted and disengaged from the second hook (14) to permit the doll to be removed from the packing box (42). Therefore, by pulling upwards the rods (30, 40), the doll can be easily unfolded and taken out from the packing box (42).

With reference to FIGS. 4–8, for folding the doll, the button (24) is pressed to pivot the linkage (22) by the lever (25), and the first joint (21) is pivoted inwards and held in the first rod (30). Then, the first rod (30) will not be blocked by the first joint (21) and can be moved downwards.

In this case, the upper plate (50) can be pressed downwards, and the second rod (40) as well as the first rod (30) is moved downwards. When abutting the first guide (26), the second joint (32) will be pushed by the inclined surface (261) to release the second limiting members (41), so the second rod (40) can be moved downwards about the first rod (30). At the same time, the line (34) is loosened, and the first hook (15) returns to the original position under the force of the first torsion spring (152) and can be engaged with the second hook (14) again. Then, the doll is folded for being stored or transported.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A device for positioning a telescopic doll in a packing box comprising:

a telescopic doll (1), including two feet (10), each foot (10) having a sole (11);

an ankle portion, an open end (101) defined at the ankle portion of the foot (10);

a seat (12) having two ears formed on the sole (11);

an opening (111) defined through the sole (11) and under the seat (12);

a shaft (121) provided between the ears of the seat (12);

a first hook (15) pivotally mounted on the seat (12) by a first pivot pin (151); and a first torsion spring (152) provided on the first pivot pin (151) and having a first end fixed on the hook (15) and a second end fixed on the seat (12);

two fixed legs (20) respectively extending upwards through the open ends (101) of the feet (10);

two first rods (30) telescopically and respectively mounted on the fixed legs (20), each first rod (30) having a line (34) extending from a bottom end of the first rod (30) through a corresponding one of the shafts (121) and connected to a corresponding one of the first hooks (15); and an upper plate (50) provided on tops of the first rods (30); and a packing box (42) for receiving the telescopic doll (1) and including a bottom plate (13) and a two second hooks (14) formed on the bottom plate (13) and respectively extending through the openings (111) in the feet (1) and detachably engaging with the first hooks (15).

2. The device for positioning the telescopic doll in the packing box as claimed in claim 1, wherein each fixed leg (20) has a first wing (201) formed at a front side;

a first joint (21) and a second torsion spring (212) pivotally mounted in the fixed legs (20) by a second pivot pin (211), the first joint (21) partially extendable from the front side of the fixed leg (20);

a first guide (26) provided at a top portion of the front side of the fixed leg (20);

an inclined surface (261) formed at a front-upper corner of the first guide (26); and a first channel (262) longitudinally defined in the first guide (26); and each first rod (30) has a second wing (301) and third wing (302) respectively formed at a front side and a rear side thereof, the third wing (302) movably received in the first channel (262) of a corresponding one of the fixed legs (20);

a second joint (32) and a third torsion spring (322) pivotally mounted in the first rod (30) by a third pivot pin (321);

a second guide (31) provided at a top portion of the front side of the first rod (30); and a second channel (311) longitudinally defined in the second guide (31).

3. The device for positioning the telescopic doll in the packing box as claimed in claim 2, further comprising two second rods (40) telescopically and respectively mounted on the first rods (30), and the upper plate (50) mounted on the second rods (40).

4. The device for positioning the telescopic doll in the packing box as claimed in claim 3, wherein each second rod (40) has a third wing (401) formed at a rear side thereof and movably received in the second channel (311) of a corresponding one of the first rods (30).

5. The device for positioning the telescopic doll in the packing box as claimed in claim 2, wherein each first rod (30) has two first limiting members (33) formed at two sides of the third wing (302) and movably attached to the first wing (201) of a corresponding one of the fixed legs (20).

6. The device for positioning the telescopic doll in the packing box as claimed in claim 4, wherein each second rod (40) has two second limiting members (41) formed at two sides of the fourth wing (401) of the second rod (40) and movably attached to the third wing (301) of a corresponding one of the fixed rods (30).

7. A device for positioning a telescopic doll in a packing box, including:

a telescopic doll, comprising:

two feet each having a sole;

a seat with two ears formed on each sole;

an opening defined through each sole; and a first hook pivotally mounted on each seat; and a packing box for receiving the telescopic doll and including a bottom plate and two second hooks formed on the bottom plate and each extending through a respective opening to detachably engage with the first hooks.

* * * * *